US006053601A

United States Patent [19]

Watanabe et al.

[11] Patent Number: 6,053,601

[45] Date of Patent: Apr. 25, 2000

[54] INK JET PRINTER

[75] Inventors: Mutsuo Watanabe; Kouichi Sanpei; Hiromitsu Soneda, all of Kawasaki, Japan

[73] Assignee: Fujitsu Limited, Kawasaki, Japan

[21] Appl. No.: 09/034,461

[22] Filed: Mar. 4, 1998

[30] Foreign Application Priority Data

Oct. 20, 1997 [JP] Japan ..... 9-287360

[51] Int. Cl.[7] ..... B41J 2/045

[52] U.S. Cl. ..... 347/70; 347/71

[58] Field of Search ..... 347/68, 70, 71, 347/72, 12

[56] References Cited

U.S. PATENT DOCUMENTS 5,260,723 11/1993 Naruse et al. ..... 347/71

5,266,965 11/1993 Komai et al. ..... 347/72

FOREIGN PATENT DOCUMENTS 6-316071 11/1994 Japan .

*Primary Examiner*—William Royer
*Assistant Examiner*—Hoan Tran
*Attorney, Agent, or Firm*—Armstrong, Westerman, Hattori, McLeland & Naughton

[57] ABSTRACT

The ink jet printer includes a pressure chamber plate having a plurality of pressure chambers 20 separated by bulkheads, and a piezoelectric member having drive sections arranged opposite to the pressure chambers via a vibrating plate. The drive sections are separated from each other by parallel extending grooves. The piezoelectric member has inner electrodes 32 embedded therein and exposed to the side surfaces of the drive sections. The exposed portions of the inner electrodes are covered by insulating members, so that no short circuit is caused between the inner electrodes provided in the piezoelectric member.

5 Claims, 6 Drawing Sheets

INK JET PRINTER

BACKGROUND OF THE INVENTION

1. Field of the Invention

The present invention relates to an ink jet printer in which ink is ejected by piezoelectric elements.

2. Description of the Related Art

Ink jet printers in which ink is ejected by piezoelectric elements are widely used in copiers, facsimiles, computers, word processors and compound machines including these functions. A conventional ink jet printer includes a pressure chamber plate, a piezoelectric member, and a vibrating plate arranged between the pressure chamber plate and the piezoelectric member. The ink jet printer further includes a nozzle plate having nozzles communicating with the pressure chambers of the pressure chamber plate.

The pressure chamber plate includes a plurality of pressure chambers separated by bulkheads. The piezoelectric member is formed as a block having drive sections separated by parallelly extending grooves and bulkhead support portions. The drive sections are arranged opposite to the pressure chambers, and the bulkhead support portions are arranged opposite to the bulkheads. Inner electrodes are arranged in the piezoelectric member to cause the drive section to extend and contract for ejecting ink.

One group of inner electrodes (positive electrodes) extend from an end surface of the piezoelectric member to the inside of the piezoelectric member, and the other group of inner electrodes (negative electrodes) extend from an opposite end surface of the piezoelectric member to the inside of the piezoelectric member. These electrodes overlap each other within the piezoelectric member and can supply a voltage to the drive sections of the piezoelectric member so that the drive sections can be extended and contracted. When the drive section is extended, the volume of the pressure chamber opposite to the drive section is reduced, so that ink can be ejected from the pressure chamber.

Japanese Unexamined Patent Publication No. 6-316071 discloses an ink jet printer which includes a piezoelectric member having vertical walls separated by a plurality of grooves and a cover plate that covers the piezoelectric member. In this the prior art, the grooves sectioned by the vertical walls and the cover plate function as both ink passages and pressure chambers, so it does not require the pressure chamber plate of the previously described ink jet printer.

Electrodes are formed on both sides of the vertical walls, and when an electric voltage is applied to the electrodes, the vertical walls are extended and contracted in the transverse direction, whereby the volume of the ink passage and pressure chamber, which are formed by the groove, can be changed and ink can be ejected. In this type ink jet printer, the electrodes provided on both sides of the vertical walls can come into contact with ink in the ink passage and pressure chamber. Therefore, a protective film is formed to cover the electrodes, so that the electrodes do not come into direct contact with ink.

In the previously described ink jet printer, the piezoelectric member is isolated from the pressure chamber plate via the vibrating plate. Therefore, ink flows only into the pressure chambers in the pressure chamber plate, and no ink flows to the piezoelectric member. Since the inner electrodes are arranged within the piezoelectric member, it is unnecessary to provide a protective film to cover the inner electrodes to protect the inner electrodes from ink.

However, in this ink jet printer, the inner electrodes are located very close to each other in the piezoelectric member, and the inner electrodes are exposed to the side surfaces of the drive sections of the piezoelectric member due to the manufacturing process. Therefore, it has been found that there is a possibility that the inner electrodes are short-circuited when water or moisture gets into the ink jet printer.

SUMMARY OF THE INVENTION

An object of the present invention is to provide an ink jet printer including a pressure chamber plate, a piezoelectric member and a vibrating plate arranged between the pressure chamber plate and the piezoelectric member, in which no short circuit is caused by the inner electrodes provided in the piezoelectric member.

An ink jet printer, according to the present invention, comprises: a pressure chamber plate having a plurality of pressure chambers separated by bulkheads; a piezoelectric member having drive sections separated from each other by parallel grooves and arranged opposite to the pressure chambers via a vibrating plate; the piezoelectric member having inner electrodes embedded in the piezoelectric member and exposed to side surfaces of the drive sections; and the exposed portions of the inner electrodes being covered with an insulating member.

In the above arrangement, portions of the inner electrodes exposed to the side surfaces of the drive sections are covered with the insulating member. Therefore, even if water or moisture enters the ink jet printer, the inner electrodes are not short-circuited.

It is preferable that the insulating member is formed by the electrophoretic method of glass to selectively cover the exposed portions of the inner electrodes. Also, it is preferable that the insulating member is formed by filling the grooves of the piezoelectric member with an insulating and water resistant material to cover the exposed portions of the electrodes. Also, it is preferable that the insulating member is formed by applying an insulating material to the piezoelectric member to cover the exposed portions of the electrodes.

It is preferable that the insulating member is made of one of rubber, resin and glass.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
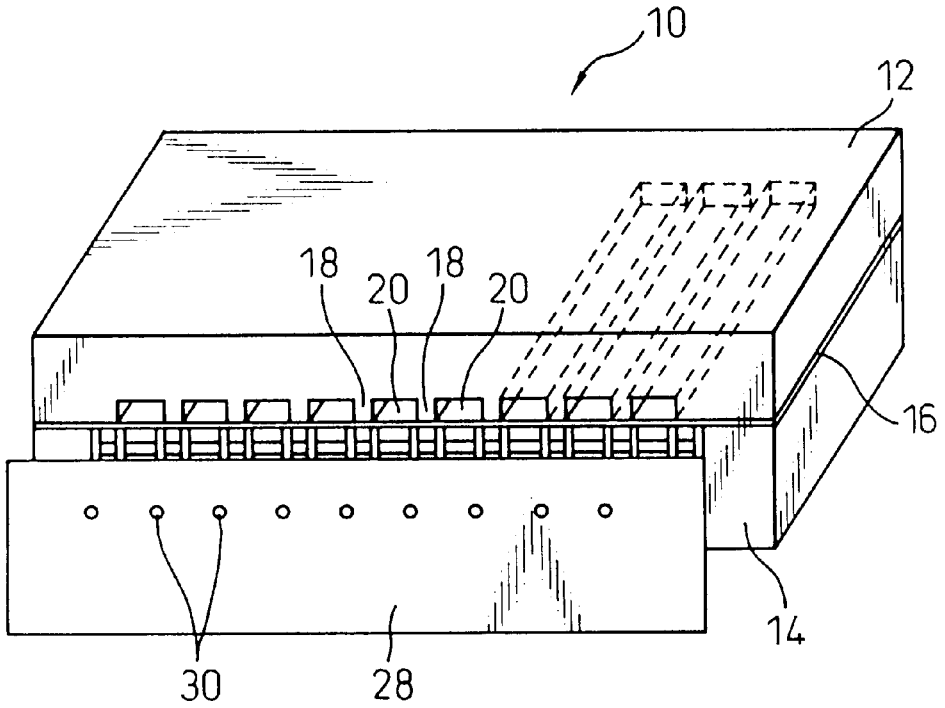
FIG. 1 is a perspective view showing an ink jet printer of the first embodiment of the present invention.
Figure 2:
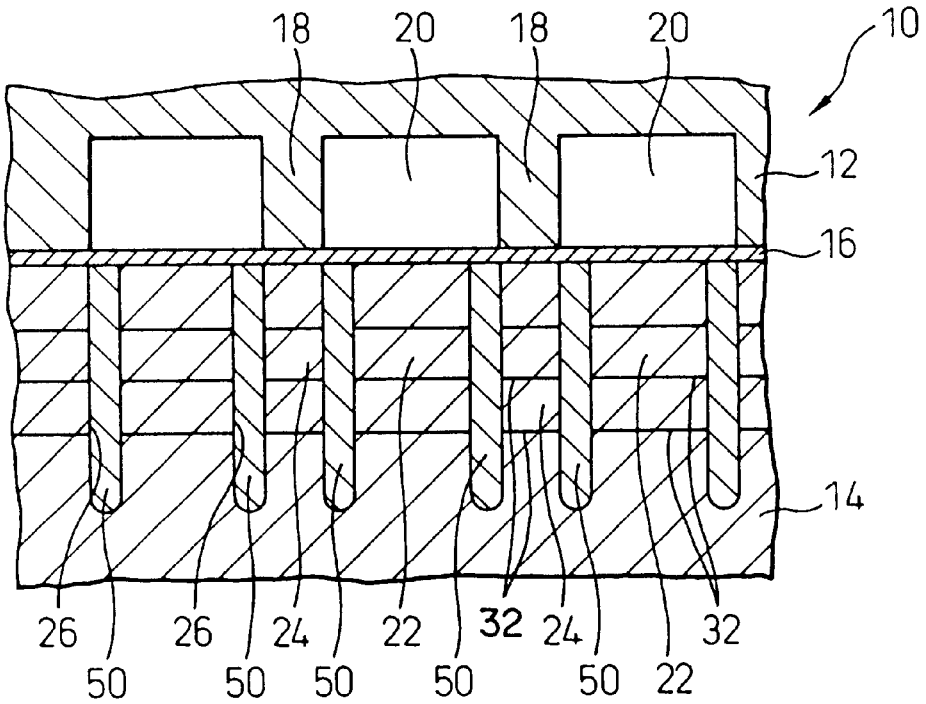
FIG. 2 is a cross-sectional view of the pressure chamber plate and piezoelectric member shown in FIG. 1.

FIGS. 1 and 2 show an ink jet printer of the first embodiment of the present invention. The ink jet printer 10 includes a pressure chamber plate 12, a piezoelectric member 14, and a vibrating plate 16 arranged between the pressure chamber plate 12 and the piezoelectric member 14. The pressure chamber plate 12 has a plurality of pressure chambers 20 separated by bulkheads 18.

Figure 3:
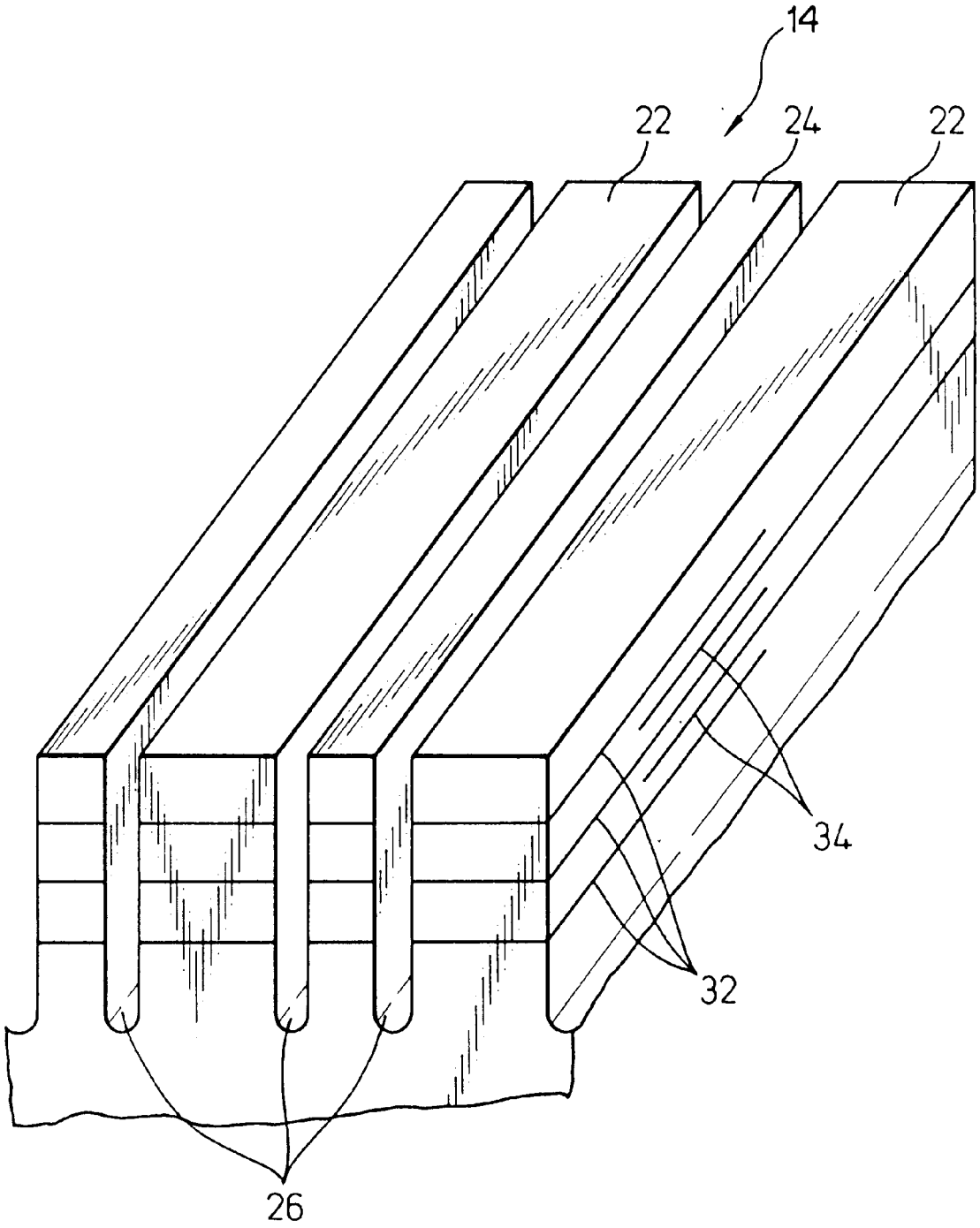
FIG. 3 is a perspective view showing a portion of the piezoelectric member before the conductive film and the insulating member are formed.
Figure 4:
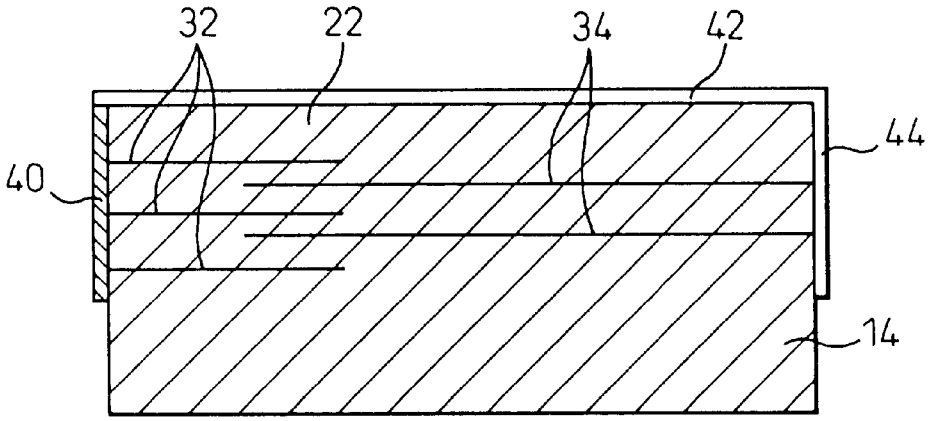
FIG. 4 is a cross-sectional view of the piezoelectric member.

As shown in FIGS. 1 to 3, the piezoelectric member 14 includes drive sections 22 arranged opposite to the pressure chambers 20 via the vibrating plate 16, and bulkhead support portions 24 arranged opposite to the bulkheads 18 via the vibrating plate 16. The piezoelectric member 14 has, at the surface thereof, parallel grooves 26, the drive sections 22 and the bulkhead support portions 24 being separated by the grooves 26. FIG. 3 is a perspective view showing a portion of the piezoelectric member 14 before conductive films 42, 44 and 46 and an insulating member 50, which will be described later, are formed.

As shown in FIG. 1, the ink jet printer 10 is provided with a nozzle plate 28 having nozzles 30. The nozzle plate 28 is adhered to the pressure chamber plate 12 so that the pressure chambers 20 can communicate with the nozzles 30. The pressure chamber plate 12 and the vibrating plate 16 are adhered to each other, and the vibrating plate 16 and the piezoelectric member 14 are adhered to each other. For example, the vibrating plate 16 is composed of a resin layer, and the pressure chamber plate 12, vibrating plate 16 and piezoelectric member 14 can be easily adhered to each other by forming adhesive layers on both sides of the vibrating plate 16 in advance.

Figure 5:
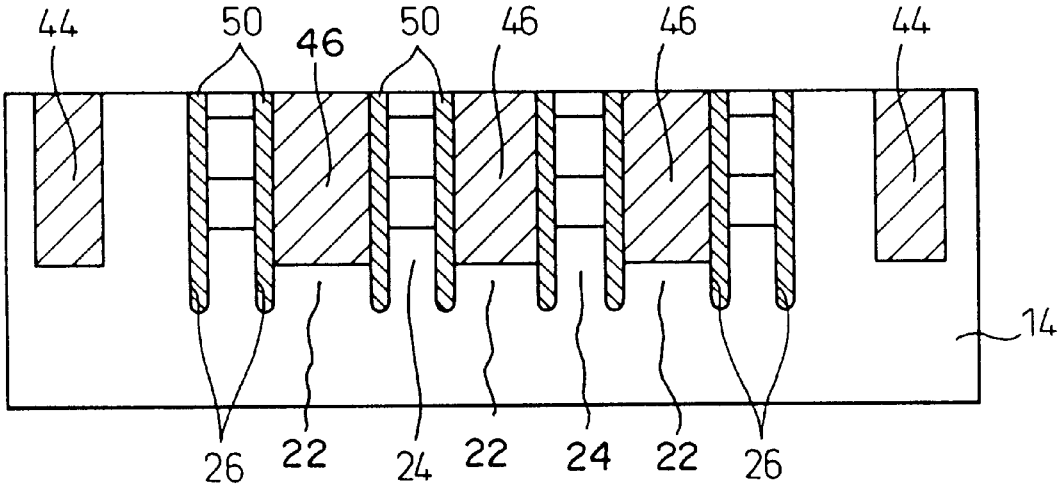
FIG. 5 is an end view of the piezoelectric member.

The piezoelectric member 14 is a one-piece piezoelectric block in which the drive sections 22, bulkhead support portions 24 and grooves 26 are integrally formed. As shown in FIGS. 3 and 5, positive inner electrodes 32 and negative inner electrodes 34 are formed within the piezoelectric member 14. The positive inner electrodes 32 extend from the front surface (the side of the nozzle plate 28) of the piezoelectric member 14 toward the rear surface side, and the negative inner electrodes 34 extend from the rear surface of the piezoelectric member 14 toward the front surface side. The positive inner electrodes 32 and the negative inner electrodes 34 overlap each other inside the piezoelectric member 14, so that a voltage can be applied to the inner electrodes 32, 34 in this overlapping portion, to drive the drive sections 22 to move toward and away from the pressure chamber 20 or the drive section 22, whereby it becomes possible to eject ink from the pressure chamber 20.

The positive inner electrodes 32 are connected, through a conductive film 40 formed on the front surface of the piezoelectric member 14 and a conductive film 42 formed on the upper surface of the piezoelectric member 14 to a conductive film 44 formed on the rear surface of the piezoelectric member 14. The negative inner electrodes 34 are connected to conductive films 46 formed on the rear surface of the piezoelectric member 14. The conductive films 44 and 46 are connected to an electric power source, not shown in the drawing.

When ink is to be ejected from the nozzle 30, a voltage is applied to a selected drive section 22 of the piezoelectric member 14 to extend this drive section 22 toward the corresponding pressure chamber 20, to thereby apply pressure to ink in the pressure chamber 20 so that ink can be ejected from the nozzle 30.

The piezoelectric member 14 having the inner electrodes 32 and 34 described above is made of a single material. The method of manufacturing the piezoelectric member 14 comprises the steps of printing a conductive layer for forming the inner electrodes on a piezoelectric material layer, positioning and laminating those piezoelectric material layers having the printed conductive layers one on another, repeating these steps, and sintering the thus laminated body into a block. Finally, the grooves 26 are cut in the block, and the piezoelectric member 14 can be obtained. The inner electrodes 32 and 34 exist in the substantially entire region of the piezoelectric member 14, and they are exposed to the side surfaces of the drive sections 22 and the bulkhead support portions 24 when the grooves 26 are formed by cutting.

Further, insulating members 50 are provided so that the portions of the inner electrodes 32, 34 exposed at the side surfaces of the drive sections 22 can be covered by the insulating members 50. The insulating members 50 are also formed on portions of the inner electrodes 32, 34 of the bulkhead support portions 24. The insulating members 50 are made of an insulating, water resistant, soft material, which is filled into the grooves 26 in the example shown in FIG. 2. An example of this insulating, water resistant, soft material is rubber such as silicon rubber. Rubber material is applied in a vacuum environment so that the rubber material can enter the grooves 26 from the upper surface of the piezoelectric member 14, and it is then vulcanized. Rubber material adhering to the upper surface of the piezoelectric member 14 is removed. Since the grooves 26 are provided for the purpose of avoiding interference of the drive sections 22 with the adjoining bulkhead support portions 24 so that the drive sections 22 can be extended and contracted, the insulating member 50 are preferably made of a soft material so that the drive sections 22 can be smoothly operated.

By providing the insulating members 50, the inner electrodes 32 and 34, which are located close to each other, are not short-circuited even if water or moisture enters the ink jet printer 10. Due to the foregoing, it is possible to provide a highly reliable ink jet printer. The width of the groove 50 is, for example, 30 to 50 $\mu$m in this embodiment, and it is impossible to form insulating members 50 in such a small space without the special idea of the present invention.

Figure 6:
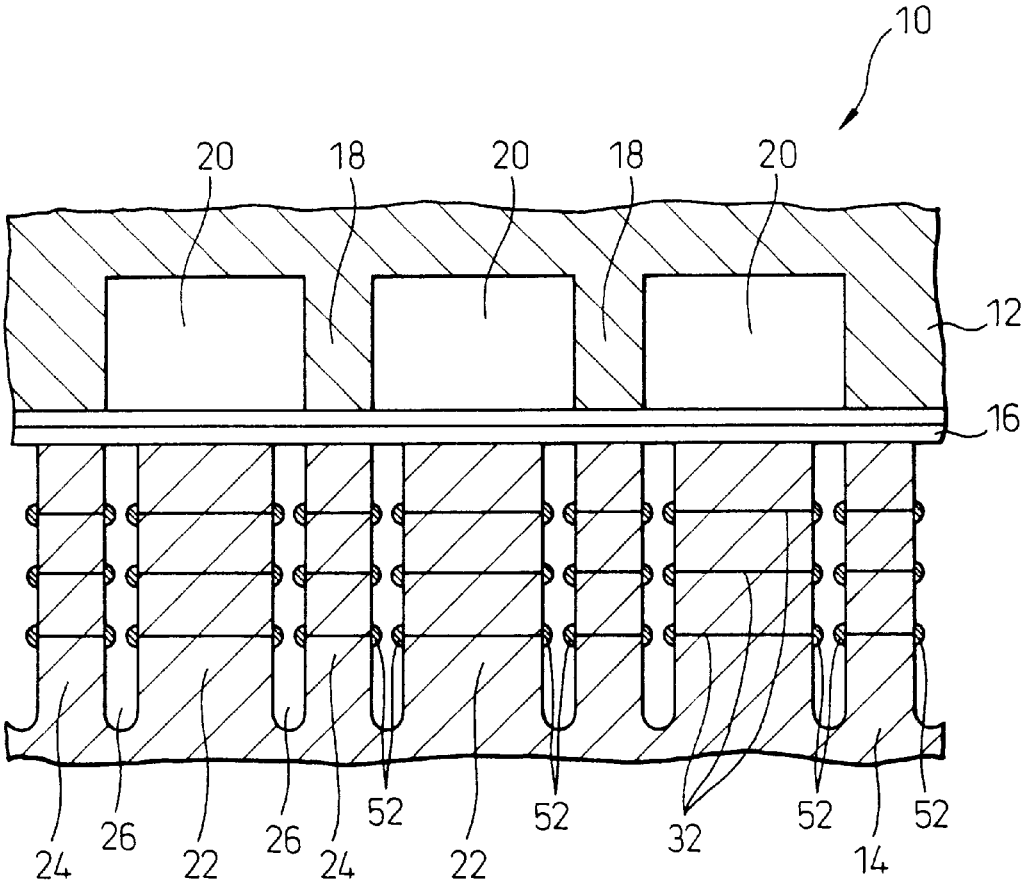
FIG. 6 is a view showing an ink jet printer of the second embodiment of the present invention.
Figure 7:
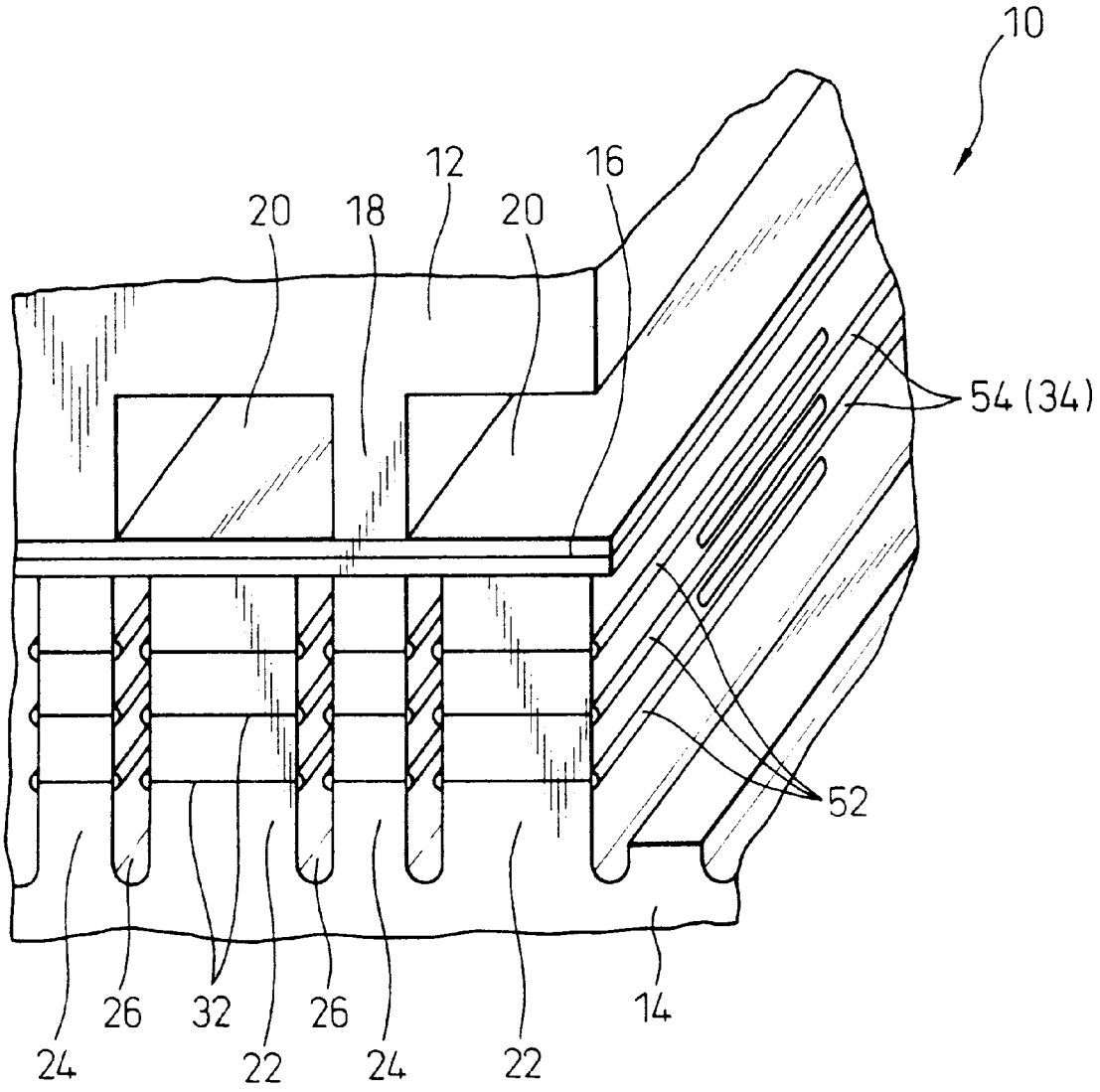
FIG. 7 is a perspective view showing a portion of the ink jet printer of FIG. 6.

FIGS. 6 and 7 show the second embodiment of the present invention. In a manner similar to that of the previous embodiment, the ink jet printer 10 includes a pressure chamber plate 12, a piezoelectric member 14, a vibrating plate 16 arranged between the pressure chamber plate 12 and the piezoelectric member 14, and a nozzle plate (not shown in the drawing). The pressure chamber plate 12 has a plurality of pressure chambers 20 separated by the bulkheads 18. The piezoelectric member 14 has drive sections 22 and bulkhead support portions 24 separated by the grooves 26.

Inner electrodes 32 and 34 are arranged inside the piezoelectric member 14. The positive inner electrodes 32 and the negative inner electrodes 34 overlap each other inside the piezoelectric member 14. When a voltage is applied to the inner electrodes 32 and 34 in this overlapping portion, it is possible to drive the drive section 22 in a direction such that the drive section 22 can be moved toward and away from the pressure chamber 20. In this way, it becomes possible to eject ink from the pressure chamber 20.

Insulating members 52 cover portions of the inner positive electrodes 32 exposed to the side surfaces of the drive sections 22, and insulating members 54 cover portions of the negative inner electrodes 32 exposed to the side surfaces of the drive sections 22. The insulating members 52 and 54 are also formed on portions of the inner electrodes 32 and 34 of the bulkhead support portions 24. In this embodiment, the insulating members 52, 54 do not fill the entire grooves 26, but comprise glass films covering only the exposed portions of the inner electrodes 32 and 34. The insulating members 52 are formed by an electrophoretic method so as to selectively cover the exposed portions of the inner electrodes 32 and 34. In the electrophoretic method, heated and liquidized glass is used and glass is adhered to the exposed portions of the inner electrodes 32, 34 while an electric current is supplied to the inner electrodes 32 and 34.

By providing the insulating members 52 and 54, the inner electrodes 32 and 34, which are located close to each other, are not short-circuited even if water or moisture enters the ink jet printer 10. Due to the foregoing, it is possible to provide a highly reliable ink jet printer.

Figure 8:
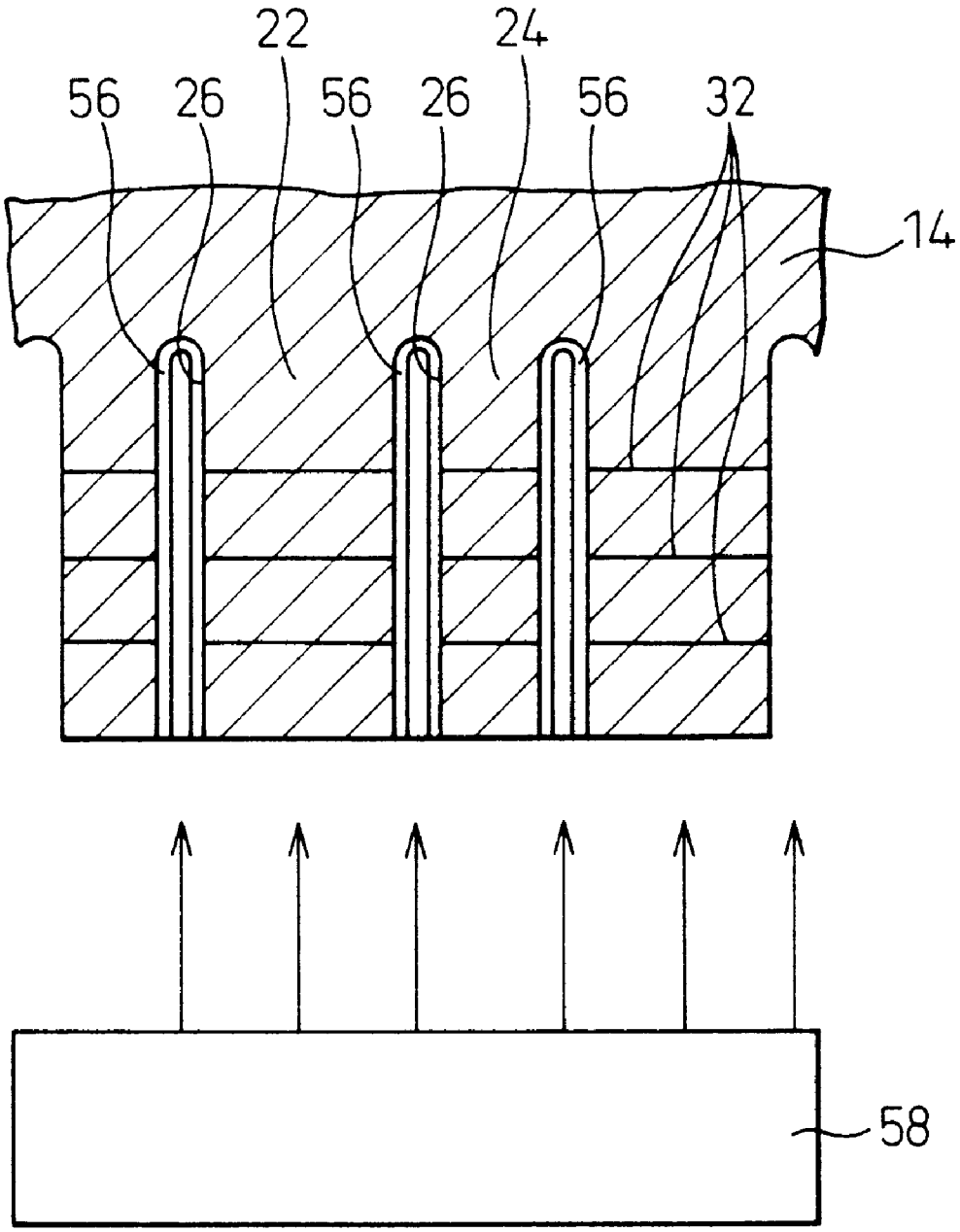
FIG. 8 is a cross-sectional view showing a piezoelectric member of the ink jet printer of the third embodiment of the present invention.

FIG. 8 shows the third embodiment of the present invention. Insulating members 56 are formed by vapor deposition of resin in this embodiment. In order to execute vapor deposition, a container 58, which contains the piezoelectric member 14 and resin, is put into a vacuum environment. Then, the container 58 or resin in the container 58 is heated so as to generate a vapor of the resin. Vapor of resin is made to adhere to the surfaces of the piezoelectric member 14 and the surfaces of the grooves 26. Resin that has adhered to the surface of the piezoelectric member 14 is removed.

As explained above, even if water or moisture enters the ink jet printer of the present invention, there is no possibility of a short circuit of the inner electrodes arranged close to each other. Accordingly, it is possible to provide a highly reliable ink jet printer.

What is claimed is:

1. An ink jet printer comprising:

a pressure chamber plate having a plurality of pressure chambers separated by bulkheads;

a piezoelectric member having drive sections separated from each other by parallel extending grooves and arranged opposite to the pressure chambers;

a vibrating plate between the pressure plate and the piezoelectric member;

the piezoelectric member having inner electrodes embedded in the piezoelectric member and exposed on side surfaces of the drive sections; and an insulating member selectively provided in the parallel extending grooves of the piezoelectric member for covering said inner electrodes exposed on the side surfaces of the drive sections.

2. An ink jet printer according to claim 1, wherein the insulating member is formed by the electrophoretic method using glass films to selectively cover the exposed portions of the inner electrodes.

3. An ink jet printer according to claim 1, wherein the insulating member is formed by filling the grooves of the piezoelectric member with an insulating and water resistant material to cover the exposed portions of the inner electrodes.

4. An ink jet printer according to claim 1, wherein the insulating member is formed by applying an insulating material to the piezoelectric member to cover the exposed portions of the inner electrodes.

5. An ink jet printer according to claim 1, wherein the insulating member is made of one of rubber, resin and glass.

* * * * *